US010039311B2

(12) United States Patent
Muehlbauer et al.

(10) Patent No.: US 10,039,311 B2
(45) Date of Patent: Aug. 7, 2018

(54) TOBACCO EXTRACT FOR NON-COMBUSTIBLE SMOKING DEVICES

(71) Applicant: Securience, LLC, Wauwatosa, WI (US)

(72) Inventors: Donald J. Muehlbauer, West Bend, WI (US); Ryan Jenson, Waukesha, WI (US); S. Anthony Pace, Delafield, WI (US)

(73) Assignee: Securience, LLC, Wauwatosa, WI (US)

( * ) Notice: Subject to any disclaimer, the term of this patent is extended or adjusted under 35 U.S.C. 154(b) by 249 days.

(21) Appl. No.: 14/884,914

(22) Filed: Oct. 16, 2015

(65) Prior Publication Data

US 2016/0106144 A1 Apr. 21, 2016

Related U.S. Application Data

(60) Provisional application No. 62/065,285, filed on Oct. 17, 2014.

(51) Int. Cl.
*A24F 47/00* (2006.01)
*A24B 15/26* (2006.01)

(52) U.S. Cl.
CPC ..... *A24B 15/26* (2013.01); *A24F 47/008* (2013.01)

(58) Field of Classification Search
CPC combination set(s) only.
See application file for complete search history.

(56) References Cited

U.S. PATENT DOCUMENTS 5,074,319 A * 12/1991 White ..... A24B 15/26 131/298
2006/0157072 A1* 7/2006 Albino ..... A24B 15/20 131/270
2006/0207618 A1* 9/2006 Prestes ..... A24B 15/24 131/297
2008/0196730 A1* 8/2008 Engstrom ..... A24B 15/16 131/352
2010/0236562 A1* 9/2010 Hearn ..... A61K 9/0043 131/330
2012/0272976 A1* 11/2012 Byrd ..... A24B 15/24 131/275
2013/0074856 A1* 3/2013 Holton, Jr. ..... A24B 13/00 131/310
2013/0206153 A1* 8/2013 Beeson ..... A24B 15/24 131/297
2014/0000638 A1* 1/2014 Sebastian ..... A24F 47/008 131/328
2017/0172199 A1* 6/2017 Nagai ..... A24B 3/04

* cited by examiner

*Primary Examiner* — Eric Yaary
(74) *Attorney, Agent, or Firm* — Boyle Fredrickson, S.C.

(57) ABSTRACT

Systems and methods for manufacturing and vaporizing a tobacco extract for use in a non-combustible smoking device are described. These methods include a solution having a volume of a liquid tobacco extract suspended in a hygroscopic liquid glycerol solvent. The systems and methods provide advantages in that the method is substantially free of water and results in an improved tobacco flavor extract.

19 Claims, 5 Drawing Sheets

TOBACCO EXTRACT FOR NON-COMBUSTIBLE SMOKING DEVICES

CROSS-REFERENCE TO RELATED APPLICATIONS

This application claims priority to U.S. provisional patent application 62/065,285 filed Oct. 17, 2014 and hereby incorporated by reference.

BACKGROUND OF THE INVENTION

1. Field of the Invention

The present invention relates in general to the field of tobacco extracts. More particularly, the present invention relates to liquid tobacco extract solutions. Specifically, a preferred embodiment of the present invention relates to a method of manufacturing a liquid tobacco extract solution for use in a non-combustible smoking device.

2. Discussion of the Related Art

A conventional form of liquid tobacco extract solution for use in a non-combustible smoking device such as an electronic cigarette is typically formed by a combination of many different highly processed ingredients, including but not limited to propylene glycol, vegetable glycerin, nicotine, and natural or artificial flavorings. Alternatively, some solutions for use in electronic cigarettes lack a nicotine component. However, generally users of electronic cigarettes prefer a solution that includes nicotine.

As is known to those skilled in the art, nicotine is a naturally occurring alkaloid compound found in tobacco leaves. Accordingly, prior attempts have been made to develop a method for extracting nicotine from tobacco leaves, for use in electronic cigarette solutions. For example, U.S. Pat. No. 8,479,747 discloses a method of subjecting tobacco to heated pressurized water to extract nicotine. However, the introduction of water as an extraction solvent presents additional drawbacks such as an increased risk of spoilage and mold growth due to the presence of water born microorganisms. Furthermore, as traditional electronic cigarette solutions are substantially free of water, the prior art method presents the additional hurdle of removing the water from the resultant nicotine solution before it can be introduced into an electronic cigarette solution. Moreover, this previously recognized solution also has the disadvantage of being relatively high cost due to the additional water removal requirements and the need for pressurization equipment during the extraction step, given that pressurized extraction is required with water to achieve the elevated temperatures of over 212° F. that is necessary for effective dissolution of the target flavor chemicals. As the electronic cigarette solution business is highly competitive, a preferred solution will be seen by the end-user as being cost effective. A solution is cost effective when it is seen by the end-user as compelling when compared with other potential uses that the end-user could make of limited resources.

Needless to say, it is desirable to develop a method of effectively extracting nicotine from tobacco leaves for use in electronic cigarette solutions without the use of water.

It is also desirable to develop a method of effectively extracting nicotine from tobacco leaves for use in electronic cigarette solutions that preserves a higher level of tobacco flavor relative to water extraction techniques.

It is also desirable to develop a method of effectively extracting nicotine from tobacco leaves for use in electronic cigarette solutions that substantially reduces the need for additional downstream processing of the nicotine extract.

SUMMARY AND OBJECTS OF THE INVENTION

By way of summary, the present invention is directed to a method of manufacturing and using liquid tobacco extract solutions.

An object of the present invention is to manufacture a nicotine extract from tobacco leaves for use in electronic cigarette solutions without the use of water.

Another object of the invention is to provide a method of vaporizing a nicotine extract from tobacco leaves in an electronic cigarette solution without the use of water.

Yet another object of the invention is to provide an apparatus for vaporizing a nicotine extract from tobacco leaves in an electronic cigarette solution without the use of water.

Another object of the invention is to provide a method that has one or more of the characteristics discussed above but which is relatively simple and increases efficiency.

In accordance with a first embodiment of the invention, these objects are achieved by providing a method comprising the steps of:

- combining a predetermined mass of ground or shredded tobacco in a predetermined mass of a hygroscopic liquid glycerol solvent to form a mixture;
- increasing the temperature of the mixture from a first temperature to an elevated second temperature, the second temperature being approximately 250 degrees Fahrenheit;
- maintaining the mixture at the elevated second temperature for a predetermined period of time to a form a solution having a volume of a liquid tobacco extract suspended in the liquid glycerol solvent;
- filtering the mixture to remove the ground tobacco or residual plant material from the solution of the liquid tobacco extract suspended in the solvent having a percentage nicotine of approximately 0.05% and a pH of approximately 5.5; and
- lowering the temperature of the solution from the second temperature to the first temperature.

In accordance with another embodiment of the invention, these objectives are achieved by providing a method comprising the steps of:

- combining a predetermined mass of ground tobacco in a predetermined mass of a hygroscopic liquid glycerol solvent to form a mixture;
- increasing the temperature of the mixture from a first temperature to an elevated second temperature, the second temperature being approximately 250 degrees Fahrenheit;
- maintaining the mixture at the elevated second temperature for a predetermined period of time to a form a solution having a volume of a liquid tobacco extract suspended in the liquid glycerol solvent;
- filtering the mixture to remove the ground tobacco from the solution of the liquid tobacco extract suspended in the solvent having a percentage nicotine of approximately 0.05% and a pH of approximately 5.5;
- lowering the temperature of the solution from the second temperature to the first temperature;
- placing a volume of the solution into a cartridge within the electronic cigarette adjacent a wicking material;
- drawing the solution into the wicking material;

vaporizing the solution in the wicking material by passing an electrical current through an atomizer.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

DESCRIPTION OF PREFERRED EMBODIMENTS

The present invention and the various features and advantageous details thereof are explained more fully with reference to the non-limiting embodiments described in detail in the following description.

Figure 1:
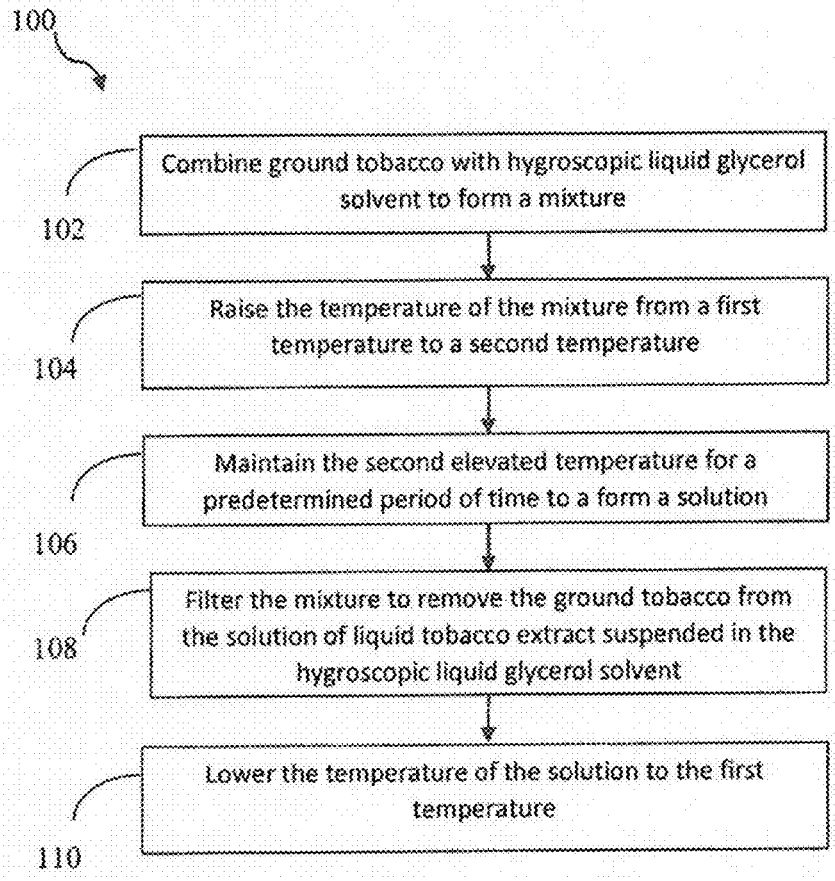
FIG. 1 illustrates a flow chart of a method of manufacturing a liquid tobacco extract according to the present invention.

Referring initially to FIG. 1, a method 100 of manufacturing a liquid tobacco extract, or extracted solution, is shown. Initially a predetermined mass of ground tobacco is combined with a predetermined mass of a hygroscopic liquid glycerol solvent to form a mixture, at block 102. The solvent may be any hygroscopic liquid glycerol; however, in one preferred embodiment the solvent is a vegetable glycerin. A hygroscopic liquid solvent, such as vegetable glycerin is preferred due to its ability to absorb water, thereby inhibiting microbial growth that may otherwise occur in a water-rich environment. The higher boiling point of glycerin permits unpressurized processing to reach the sterilization temperature. Furthermore, as glycerol is a known ingredient in the compositions of electronic cigarette solutions, directly extracting tobacco into the glycerol reduces subsequent downstream manufacturing steps.

During the course of experimentation, various solvents were tested for tobacco extraction efficiency. As shown below in Table 1, an identical mass of various solvents were tested against an identical mass of ground tobacco to test both a tobacco extract value in the resultant solutions using an objective color comparison as well as a tobacco flavor taste test. Throughout this experiment and those that follow, flavor testing was performed by a blind panel of tobacco smokers that rated each sample on a numerical scale relative to various taste factors including but not limited to: tobacco leaf taste, tobacco cure taste, and taste comparison to conventional cigarettes. The numerical results of these panel tastings were compiled and regression analysis applied thereto. Of the tested solvents, the hygroscopic liquid glycerol, namely vegetable glycerin, resulted in the most effective extraction of desirable tobacco flavor compounds and nicotine.

TABLE 1

| Ground Tobacco (grams) | Solvent (grams) | Flavor Result | Tobacco Solute Extraction Results |
|---|---|---|---|
| 37.8 | 482.9 Alcohol | Not suitable for consumption due to high alcohol content | 3rd most favorable |
| 37.8 | 482.9 Water | Weak taste, water damages smoking device | Least favorable, weakest |
| 37.8 | 482.9 Propylene Glycol | Weak taste | 2nd most favorable |
| 37.8 | 482.9 Vegetable Glycerin | Most favorable | Most favorable, darkest solution by far |

Furthermore, various weights of ground tobacco and the hygroscopic liquid glycerol solvent were tested to identify a preferred effective ratio of solvent to ground tobacco for producing a resultant extract that was well suited for use in non-combustible smoking devices. As shown below in Table 2, various ratios of ground solvent weight to tobacco weight were tested. The nicotine and tobacco extraction of the resultant solutions were then compared by both an objective color comparison and a tobacco flavor taste test, in accordance with the testing method previously described. As a result of this testing, in accordance with one embodiment of the present invention, a preferred mass ratio of solvent to ground tobacco is approximately between 19:1 and 21:1, and preferably approximately 20:1.

TABLE 2

| Ground Tobacco (grams) | Vegetable Glycerin Solvent (grams) | Ratio of Vegetable Glycerin to Tobacco |
|---|---|---|
| 162.99 | 644.7 | 3.9 |
| 75.6 | 643.9 | 8.5 |
| 37.8 | 482.9 | 12.7 |
| 37.8 | 643.9 | 17.0 |
| 19.5 | 372.8 | 19.1 |
| 264.1 | 5141.3 | 19.5 |
| 236 | 5054.4 | 21.4 |

This mass ratio of approximately 20:1 may be reproduced in any volume to produce a resultant tobacco extraction solution of a desired mass or volume, provided that the approximate preferred ratio of the present invention is maintained. Furthermore, while a preferred ratio of solvent to ground tobacco has been provided, alternative ratios, for producing resultant tobacco extraction solutions of various strength, either weaker or stronger, is considered well within the scope of this invention. Additionally, it is also considered well within the scope of this invention that the mass of tobacco be increased relative to solvent to produce a concentrated resultant tobacco extraction solution, which may or may not be diluted prior to subsequent vaporization, as will be described in further detail below.

In addition to the objective color comparison and the tobacco flavor taste test, as were described above, extracts of various mass ratios of the ground tobacco and the hygroscopic liquid glycerol solvent were tested via spectrophotometry. In this test, three samples were prepared. A half concentration sample was prepared according to the method of the present invention, including approximately a 40:1 mass ratio of vegetable glycerin to ground tobacco. Similarly, a standard concentration sample was prepared according to the method of the present invention, including approximately a 20:1 mass ratio of vegetable glycerin to ground tobacco. Lastly, a double concentration sample was prepared according to the method of the present invention, including approximately a 10:1 mass ratio of vegetable glycerin to ground tobacco. All of the samples were prepared according to method 100, of the present invention. Absorbency of these three samples were tested via spectrophotometry over a range of approximately 325 nm to 800 nm wavelength light. Absorbance is reported in absorbance units (AU), herein throughout.

As shown in Table 3 below and corresponding chart 200 in FIG. 2, increasing the mass ratio of ground tobacco to vegetable glycerin results in an increased strength of the resultant extracted solution, as is evidenced by the relatively higher absorbance of the double concentration sample as compared to the remaining samples at each tested wavelength.

TABLE 3

| λ, nm | Half Concentration | Standard Concentration | Double Concentration |
|---|---|---|---|
| 300 | | | |
| 325 | 1.460 | 1.700 | |
| 350 | 1.540 | 1.950 | |
| 375 | 1.240 | 1.800 | |

TABLE 3-continued

| λ, nm | Half Concentration | Standard Concentration | Double Concentration |
|---|---|---|---|
| 400 | 0.900 | 1.370 | |
| 425 | 0.648 | 1.025 | |
| 450 | 0.478 | 0.778 | 2.000 |
| 475 | 0.347 | 0.580 | 1.720 |
| 500 | 0.264 | 0.446 | 1.360 |
| 525 | 0.205 | 0.350 | 1.090 |
| 550 | 0.168 | 0.283 | 0.885 |
| 575 | 0.134 | 0.227 | 0.722 |
| 600 | 0.116 | 0.195 | 0.614 |
| 625 | 0.103 | 0.171 | 0.518 |
| 650 | 0.117 | 0.176 | 0.470 |
| 675 | 0.191 | 0.246 | 0.498 |
| 700 | 0.374 | 0.430 | 0.650 |
| 725 | 0.642 | 0.716 | 0.925 |
| 750 | 0.875 | 1.035 | 1.280 |
| 775 | 0.950 | 1.240 | 1.660 |
| 800 | 0.875 | 1.240 | 2.000 |

Figure 2:
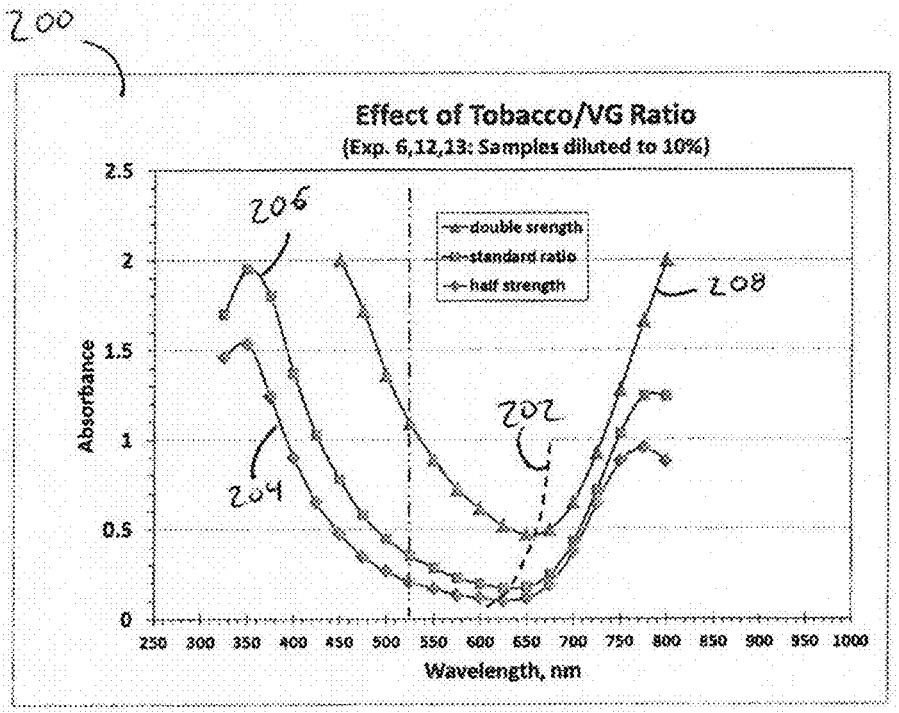
FIG. 2 shows a chart of the spectrophotometry absorbance of various liquid tobacco extracts manufactured according to the present invention relative to wavelength, where the various liquid tobacco extracts have differing tobacco to vegetable glycerin ratios.

However, the test results shown in Table 3 and FIG. 2 revealed the unexpected result that the minimum, i.e., lowest measured absorbance, for each of the tested samples did not occur at the same wavelength amongst all samples. This lowest measured absorbance is shown by the dashed line 202 which intersects the half concentration trend line 204, the standard concentration trend line 206 and the double concentration trend line 208 at their respective lowest measured absorbance. Specifically, the lowest measured absorbance for the half concentration and standard concentration sample occurred at the 625 nm wavelength, while the double concentration sample's lowest measured absorbance was recorded at a 650 nm wavelength. This shift towards the red end, i.e., higher wavelength, of the spectrum, present between 650 and 700 nm, indicates that increasing the mass ratio of ground tobacco to vegetable glycerin does not result in a linear proportional increase in absorbency across the complete tested spectrum. Rather, FIG. 2 shows that increasing the mass ratio of ground tobacco to vegetable glycerin results in a change in the proportional amount of extracted ground tobacco chemicals present in the extracted solution that absorb light at the red spectrum (650-750 nm). That is to say, that increasing the mass ratio of ground tobacco to vegetable glycerin does not simply increase the concentration of all extracted ground tobacco chemicals present in the extracted solution, but that it rather changes the chemical composition of the solution. The inventors have found this shift toward the red spectrum in the double concentration sample to be an unexpected result of method 100.

In comparison to the above mentioned tobacco flavor taste test, which was conducted in accordance with the testing method previously described, testers identified a more prevalent tobacco leaf taste with those extracts that absorbed relatively more light from the blue spectrum, and identified a more prevalent tobacco cure taste with those extracts that absorbed relatively more light from the red spectrum. As such, the general shift of the double concentration sample towards the red spectrum, as evidenced by dashed line 202, was consistent with a more prevalent tobacco cure taste amongst the flavor taste test. In attempting to emulate the flavor profile of a traditional cigarette, the tobacco flavor taste test indicated that the shift of the double concentration trend line 208 exhibited an undesirable tobacco cure taste. Accordingly in one embodiment of the present invention the desired tobacco extracted solution has a minimum absorbance of approximately 625 nm. However, as forming extracts of various flavor profiles are considered within the scope of this invention, a minimum absorbance of less than or greater than 625 nm are also considered within the scope of this invention.

Returning now to method 100 of FIG. 1, at subsequent block 104 the temperature of the ground tobacco and hygroscopic liquid glycerol mixture is raised from a first temperature, that is approximately room temperature, to an elevated second temperature. Again, during the course of experimentation, testing was performed to identify an effective elevated second temperature. Multiple mixtures from block 102 were heated to various internal temperatures by placing them within a 400 degree Fahrenheit oven for various periods of time, namely, one, two, three, four hours. After the mixtures had been heated for the corresponding period of time, the resultant tobacco extraction solutions were subjected to various testing, including an achieved temperature test, a pH value test, a darkness test, and a nicotine content test. Darkness or concentration of total dissolved tobacco extract was measured using known dilutions and an objective color match. Because, heating the mixture to various elevated temperatures resulted in tobacco extraction solutions of various concentrations, each of the resultant tobacco extraction solutions were diluted until they had an approximately equal color, i.e., concentration, and the these diluted solutions were taste tested in a non-combustible smoking device, in accordance with the previously described method. The results of this test are shown below in Table 4. As a result of this testing, in accordance with one embodiment of the present invention, the elevated second temperature may preferably be between 225.0° F. and 275.0° F., and more preferably may be approximately 250° F.

TABLE 4

| Elevated Temperature (° C.) | Elevated Temperature (° F.) | Diluted Taste/ Flavor Result | pH Value | Darkness | Nicotine Content % |
|---|---|---|---|---|---|
| 75 | 167.0 | 1.3 | 5.3 | 200 | 0.01682 |
| 120 | 248.0 | 3.0 | 5.3 | 1000 | 0.04699 |
| 148 | 298.4 | 2.3 | 6.0 | 2000 | 0.04910 |
| 168 | 334.4 | 2.3 | 7.3 | 5000 | 0.04219 |

At the following block 106, the second elevated temperature of the mixture was maintained for a predetermined period of time to a form a solution having a volume of a liquid tobacco extract suspended in the liquid glycerol solvent. Testing was also performed to identify a preferred predetermined time period at which to hold the mixture at the second elevated temperature. During this testing, multiple mixtures from block 102 were heated at the same elevated temperature of approximately 250 degrees Fahrenheit for various periods of time; 1, 2, 3, and 4 hours respectively. After the mixtures had been heated, the resultant tobacco extraction solutions were subjected to various testing, including a pH value test, a darkness test, and a nicotine content test. Additionally, because heating for various durations resulted in tobacco extraction solutions of various concentrations, each of the resultant tobacco extraction solutions were diluted until they had an approximately equal color, i.e., concentration, and then these diluted solutions were taste tested in a non-combustible smoking device as previously described. The results of this test are shown below in Table 5. As a result of this testing, in accordance with one embodiment of the present invention, the predetermined period of heating at the elevated second temperature may preferably be between 100 minutes and 150 minutes, and more preferably may be approximately 120 minutes.

TABLE 5

| Elevated Temperature (° F.) | Time Exposed to Elevated Temperature (minutes) | Diluted Taste/ Flavor Result | pH Value | Darkness | Nicotine Content % |
|---|---|---|---|---|---|
| 250 | 60 | 1.6 | 5.3 | 667 | 0.03912 |
| 250 | 120 | 2.6 | 5.3 | 1000 | 0.04474 |
| 250 | 180 | 2.9 | 5.4 | 1000 | 0.05107 |
| 250 | 240 | 3.0 | 5.5 | 1000 | 0.04747 |

In addition to the various testing reported above in Table 5, multiple mixtures from block 102 were again heated at the same elevated temperature of approximately 250 degrees Fahrenheit for various periods of time; 1, 2, 3, and 4 hours respectively. After the mixtures had been heated, the resultant tobacco extraction solutions were tested via spectrophotometry. Absorbency of four samples were tested via spectrophotometry over a range of approximately 325 nm to 800 nm wavelength light, and absorbance is recorded in absorbance units (AU).

As shown in Table 6 below and corresponding chart 300 in FIG. 3, increasing the duration of heating the mixtures at an elevated temperature results in an increased strength of the resultant extracted solution, as is evidenced by the relatively higher measured absorbance for those samples that were heated for a relatively longer period. That is to say that higher absorbance numbers indicate a stronger extract, or alternatively an extract having more extracted ground tobacco related chemicals therein. Accordingly, as heat time increases, the amount of flavor compounds extracted from the ground tobacco increase as evidenced by the upward shift of the trend lines of FIG. 3, with processing time.

TABLE 6

| λ, nm | 60 min | 120 min | 180 min | 240 min |
|---|---|---|---|---|
| 300 | | | | |
| 325 | 1.025 | 1.700 | | |
| 350 | 0.875 | 1.950 | | |
| 375 | 0.568 | 1.780 | | |
| 400 | 0.373 | 1.340 | | |
| 425 | 0.273 | 1.005 | | |
| 450 | 0.211 | 0.764 | 1.950 | |
| 475 | 0.165 | 0.574 | 1.600 | |
| 500 | 0.131 | 0.442 | 1.280 | 1.950 |
| 525 | 0.107 | 0.350 | 1.030 | 1.680 |
| 550 | 0.092 | 0.282 | 0.845 | 1.380 |
| 575 | 0.080 | 0.231 | 0.702 | 1.150 |
| 600 | 0.072 | 0.199 | 0.604 | 0.985 |
| 625 | 0.069 | 0.176 | 0.520 | 0.835 |
| 650 | 0.084 | 0.179 | 0.478 | 0.740 |
| 675 | 0.156 | 0.251 | 0.512 | 0.730 |
| 700 | 0.312 | 0.436 | 0.670 | 0.860 |
| 725 | 0.474 | 0.730 | 0.955 | 1.120 |
| 750 | 0.510 | 1.030 | 1.300 | 1.460 |
| 775 | 0.452 | 1.230 | 1.680 | 1.850 |
| 800 | 0.380 | 1.220 | 1.950 | |
| 825 | | | | |

Figure 3:
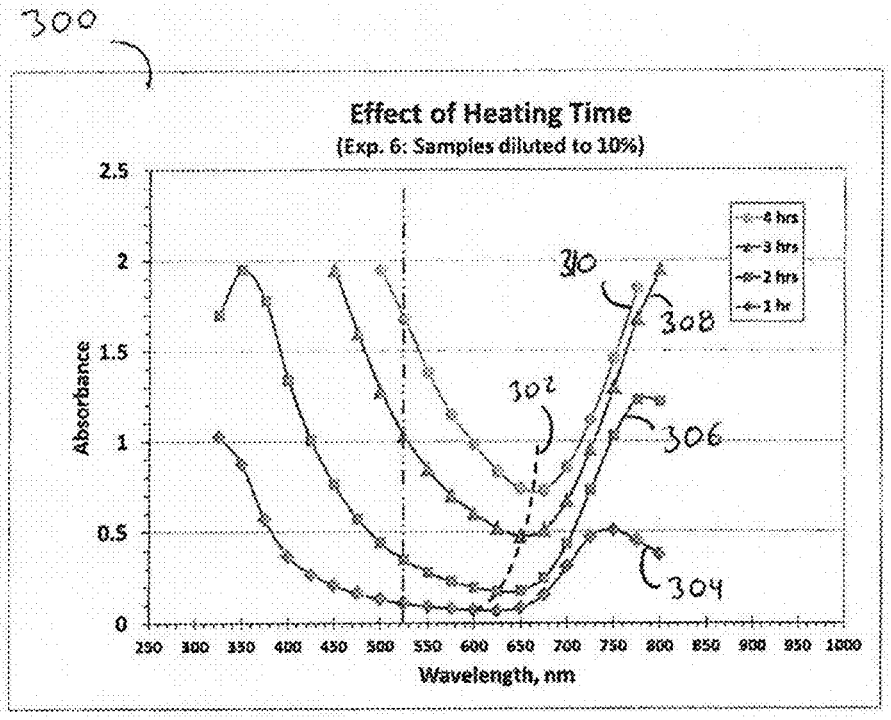
FIG. 3 shows a chart of the spectrophotometry absorbance of various liquid tobacco extracts manufactured according to the present invention relative to wavelength, where the various liquid tobacco extracts have been heated to an elevated temperature for differing durations of time.

However, the test results shown in Table 6 and FIG. 3 revealed the unexpected result that the minimum, i.e., lowest measured absorbance, for each of the tested samples did not occur at the same wavelength amongst all samples. This is similar to the result shown in FIG. 2 regarding mass ratio of tobacco to vegetable glycerin.

In FIG. 3, the lowest measured absorbance is shown by the dashed line 302 which intersects the 1 hour heat time trend line 304, the 2 hour heat time trend line 306, the 3 hour heat time trend line 308 and the 4 hour heat time trend line 310 at their respective lowest measured absorbance. Specifically, the lowest measured absorbance for the 1 hour heat time sample occurred at 625 nm, the lowest measured absorbance for the 2 hour heat time sample occurred at 625 nm, the lowest measured absorbance for the 3 hour heat time sample occurred at 650 nm, and the lowest measured absorbance for the 4 hour heat time sample occurred at 675 nm. Again, this shift in these lowest measured absorbance, as indicated by the curve of dashed line 302 towards the red end of the spectrum, present between 650 and 700 nm, indicates that increasing the heating time of the mixture of ground tobacco and vegetable glycerin does not result in a linear proportional increase in absorbency across the complete tested spectrum. Rather, FIG. 3 shows that increasing the heating time of the mixture of ground tobacco and vegetable glycerin results in a change in the proportional amount of extracted ground tobacco chemicals present in the solutions that absorb light at the red spectrum (650-750 nm). That is to say, that increasing the mass ratio of ground tobacco to vegetable glycerin does not simply increase the concentration of all extracted ground tobacco chemicals present in the extracted solution, but that it rather changes the chemical composition of the extracted solution. Again, the inventors have found this curve of line 302 toward the red spectrum to be somewhat unexpected.

Additionally, as seen in FIG. 3, the amount of extracted ingredients that absorb at the blue end of the spectrum (350-450 nm) increases proportionately more than those extracted ingredients towards the red spectrum (650-750 inn). This indicates that changing the heating time changes the formulation of the solution, and simply does not result in a greater extraction of the same proportion of the extracted ground tobacco chemicals. The inventors believe that this shift is due at least in part to less easily soluble entities leaching out of the tobacco leaf material during a prolonged heat application.

Once again, in comparison to the above mentioned tobacco flavor taste test, which was conducted in accordance with the testing method previously described, testers identified a more prevalent tobacco leaf taste with those extracts that absorbed relatively more light from the blue spectrum, and identified a more prevalent tobacco cure taste with those extracts that absorbed relatively more light from the red spectrum. As such, the general shift towards the red spectrum of the samples that were heated longer, as evidenced by dashed line 302, was consistent with a more prevalent tobacco cure taste amongst the flavor taste test. In attempting to emulate the flavor profile of a traditional cigarette, the tobacco flavor taste test indicated that the shift of the 3 and 4 hour heated samples 308 and 310, exhibited an undesirable tobacco cure taste. Accordingly in one embodiment of the present invention the desired tobacco extracted solution has a minimum absorbance of approximately 625 nm. However, as forming extracts of various flavor profiles are considered within the scope of this invention, a minimum absorbance of less than or greater than 625 nm are also considered within the scope of this invention.

Returning now to FIG. 1 and method 100, once the mixture has been heated at the second elevated temperature for a predetermined period of time, the mixture is then filtered to remove the ground tobacco from the solution of liquid tobacco extract suspended in the solvent, at block 108. The resultant solution of the liquid tobacco extract suspended in the solvent preferably has a percentage nicotine of approximately between 0.04% and 0.06%, and more preferably, approximately 0.05%. Additionally, the resultant solution of the liquid tobacco extract suspended in the solvent preferably has a pH value of approximately between 5.3 and 7.3, and more preferably, approximately 6.3. Furthermore, in addition to the extraction of nicotine from the ground tobacco, minor tobacco alkaloids and tobacco-specific nitrosamines are also extracted into the solvent, which are also believed to impact the taste and flavor profile of the resultant liquid tobacco extract solution according to one embodiment of the present invention.

In one embodiment of the present invention, the filtration that occurs at block 108 may occur at standard atmospheric pressure, i.e., approximately 101.325 Kilopascals. That is to say, that no external force is exerted on the mixture to filter out the ground tobacco from the solution of liquid tobacco extract suspended in the solvent. However, due to the fact that some solution may be suspended in the filtered ground tobacco, it may be desirable to exert an external force during the filtration process, in order to recover a larger percentage of liquid tobacco extract suspended in the solvent. Accordingly, in another embodiment of the present invention the filtration at block 108 may occur at an elevated pressure of approximately between 101.325 Kilopascals and 1,500 Kilopascals, and more preferably, approximately 1,500 Kilopascals. For example a pressurized filter device may be used during the filtration at block 108. However, any other pressure greater than standard atmospheric pressure is also considered within the scope of this invention.

During the course of experimentation, additional testing was performed to test the resultant solutions of liquid tobacco extract suspended in the solvent that was processed at standard atmospheric pressure relative to that filtered at a high pressure. After the respective solutions had been filtered, according to their respective methods, they were subjected to various testing, including a color match test a taste tested in a non-combustible smoking device. The results of these tests revealed no discernible difference between color, i.e., concentration, or taste of the resultant solutions of liquid tobacco extract suspended in the solvent that was processed at standard atmospheric pressure relative to that filtered at a high pressure. Accordingly, these tests confirmed that the preferred approximate pressure applied during the pressurized filtration, at block 108, alone is insufficient to remove additional bound nicotine containing liquid from within the cellular structure of the tobacco leaf.

In another embodiment of the invention, filtration at block 108 may include multiple filtrations, where such filtrations include progressively finer filtrations mediums to further reduce the occurrence of particulates remaining in the subsequent solution. Such additional filtration does not affect the flavor, taste or strength of the filtered solution when it is tested in a non-combustible smoking device.

Then at subsequent bock 110, the temperature of the solution is then lowered from the second temperature to the first temperature. In one embodiment of the present invention, the first temperature is approximately room temperature.

Additionally, in one embodiment of the present invention where the resultant nicotine percentage was higher than that desired for use in a non-combustion smoking devise liquid, such as the manufacturing of a concentrated liquid tobacco extract, the method 100 may also include the subsequent step of adding a predetermined mass of a solvent to the resultant solution to form a liquid tobacco extract having a final percentage nicotine of preferably, approximately between 0.04% and 0.06%, and more preferably, approximately 0.05%. That is to say, that the resultant solution of liquid tobacco extract suspended in the solvent may be diluted by means of adding additional solvent to the solution. The additional solvent may be of the same type used during the proceeding extraction steps, namely a hygroscopic liquid glycerol solvent, or alternatively may be a solvent commonly used in the manufacture of liquid for non-combustible smoking devices, such as, but not limited to propylene glycol and flavoring additives.

During the course of experimentation, additional testing was performed to test the resultant solutions of liquid tobacco extract suspended in the solvent that was processed at standard atmospheric pressure relative to that filtered at a high pressure. After the respective solutions had been filtered, according to their respective methods, they were subjected to various testing, including a color match test a taste tested in a non-combustible smoking device. The results of these tests revealed no discernible difference between color, i.e., concentration, or taste of the resultant solutions of liquid tobacco extract suspended in the solvent that was processed at standard atmospheric pressure relative to that filtered at a high pressure. Accordingly, these tests confirmed that the preferred approximate pressure applied during the pressurized filtration, at block 108, alone is insufficient to remove additional bound nicotine containing liquid from within the cellular structure of the tobacco leaf.

Figure 4:
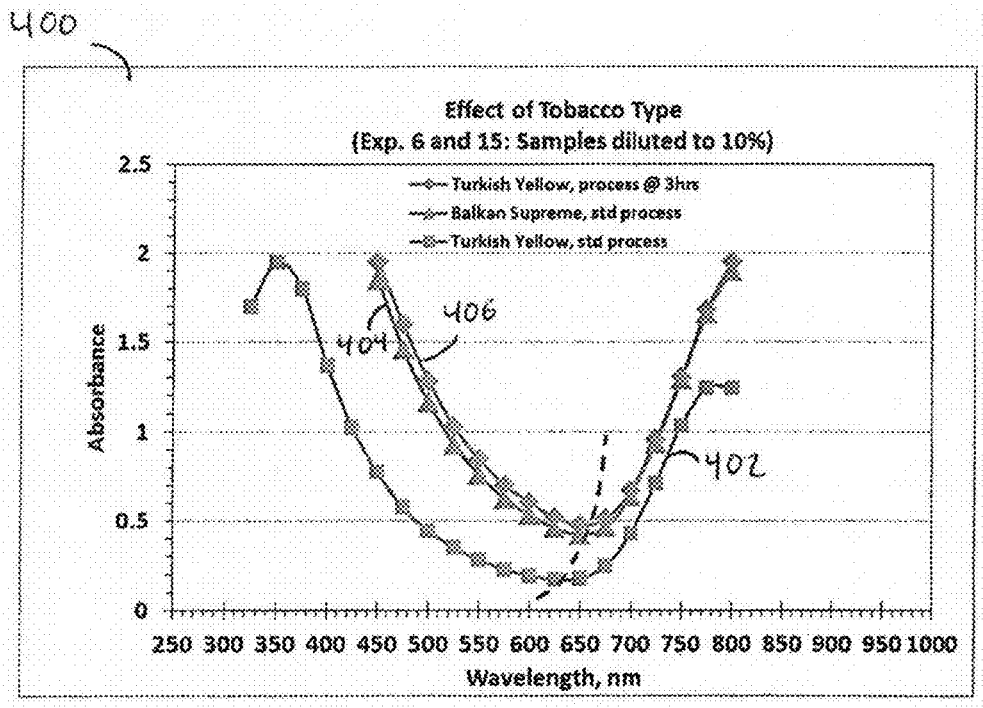
FIG. 4 shows a chart of the spectrophotometry absorbance of various liquid tobacco extracts manufactured according to the present invention relative to wavelength, where the various liquid tobacco extracts include different varieties of tobacco leaves and have been heated to an elevated temperature for differing durations of time.

While the method 100 of the present invention is in no way limited to use with a single type of tobacco leaf, or blend of tobacco leaves, the inventors appreciate that different tobacco leaves will respond differently, and require slight modifications to the method 100 of the present invention. To this end, the inventors tested several different tobacco mixes, the results of which are shown in FIG. 4.

Generally, most of the relatively less expensive U.S. grown tobacco cigar mixes available exhibit significant similarities as cigarette type tobaccos, but are simply identified as cigar tobacco. The inventors have identified that very little flavor differences resulted when varying the tobacco mix among these two types of tobacco. That is to say that typical flavor testers could not tell the difference between them.

To objectively test the impact of large changes in the type of tobacco used in the method of the present invention, the applicants preformed a spectrophotometry comparison between a Balkan Supreme tobacco and two samples of a Turkish tobacco blend, which has been referred to herein as applicant's standard tobacco. The Turkish tobacco has been objectively recognized to be milder tobacco relative to the Balkan Supreme.

Specifically, multiple solutions were manufactured according to the present embodiment, including 1 sample containing the Turkish (standard) tobacco heated for approximately 2 hours, 1 sample containing the Turkish tobacco that had been heated for approximately 3 hours, and 1 sample containing the Balkan Supreme tobacco heated for approximately 2 hours. After the mixtures had been heated, the resultant tobacco extraction solutions were tested via spectrophotometry. Absorbency of three samples were tested via spectrophotometry over a range of approximately 325 nm to 800 am wavelength light.

As seen in chart 400 of FIG. 4, the optical spectrum obtained from the standard Turkish tobacco extract, shown as trend line 402, exhibits substantially less absorption than the results for a Balkan Supreme tobacco extract, shown as trend line 404, when both are subjected to 2 hour heating and standard processing conditions. Furthermore, chart 400 also shows the spectrum for the Turkish tobacco obtained with a 50% increase in heating time, i.e., 3 hours of heating, identified as trend line 406 is highly similar to that of Balkan Supreme tobacco extract trend line 404.

These results demonstrate a significant advantage of the method of the current invention. Initially it is noted that the Balkan Supreme tobacco was specifically selected for this test because the shredded raw leaf material itself has a much stronger, almost acrid, aroma as compared to the milder Turkish Yellow when smelled in the dry state. The difference in its flavor profile is substantial as to be unmistakable.

Based in part on this distinct flavor profile, the data shown in FIG. 4 confirms that the Balkan Supreme tobacco blend produces a considerably stronger extracted solution under equal processing conditions, as was expected. However, the Balkan Supreme extract obtained under the standard process is remarkably similar to that of the Turkish tobacco that was subject to a 50% increase in heating duration, shown in trend line 406. This similarity is consistent with the findings shown in FIG. 3, that increased heating time results in a shift towards the red end of the spectrum, which is synonymous with the tobacco cure flavor profile, i.e., exhibits an ashier, somewhat "burnt" quality. Because the Balkan Supreme tobacco has a high percentage of highly cured leaf in its blend, it is believed that this extra curing of the tobacco plant material appears to produce flavor compounds similar to those induced in the extracted solution by the method of the present invention.

However, despite similar absorption trend lines, some subjective taste testers were able to detect a difference in the taste of the Balkan Supreme blend that was heated for 2 hours from a Turkish blend that was heated for approximately 3 hours according to the present invention. Specifically, the taste testers indicated that the Balkan Supreme blend tastes stronger or sharper, as in more flavoring components consistent with the curve, but not as ashy/burnt.

In another aspect of the present invention, experiments were performed to verify the uniform production of a product according to method 100. Namely, statistical process control (SPC) techniques are a well-established means for ensuring the manufacture of a quality product in a commercial environment. As for method 100, factors such as consistency of ground tobacco and glycerol, as well as the control of processing conditions (e.g. heating temperature and duration) are critical to obtaining a uniform product from batch to batch. However, this technique is not always sufficient when dealing with a natural ingredient such as tobacco leaf. Variations in the raw plant material due to factors like cultivation, growing location, curing method, etc. may have an impact on the resultant flavor components available for extraction via method 100. Moreover, taste testing for extract quality is not usually considered practical in a commercial manufacturing environment. It is thus more desirable to have an objective method available for quality control of the product.

Therefore, in order to create a quality control measure for the quality and consistency of various batches of extracted solution created according to method 100, spectrophotometric data on extract samples was analyzed over a range of concentrations and wavelengths of light. This test confirms that light absorbency can be used in routine production quality control.

Figure 5:
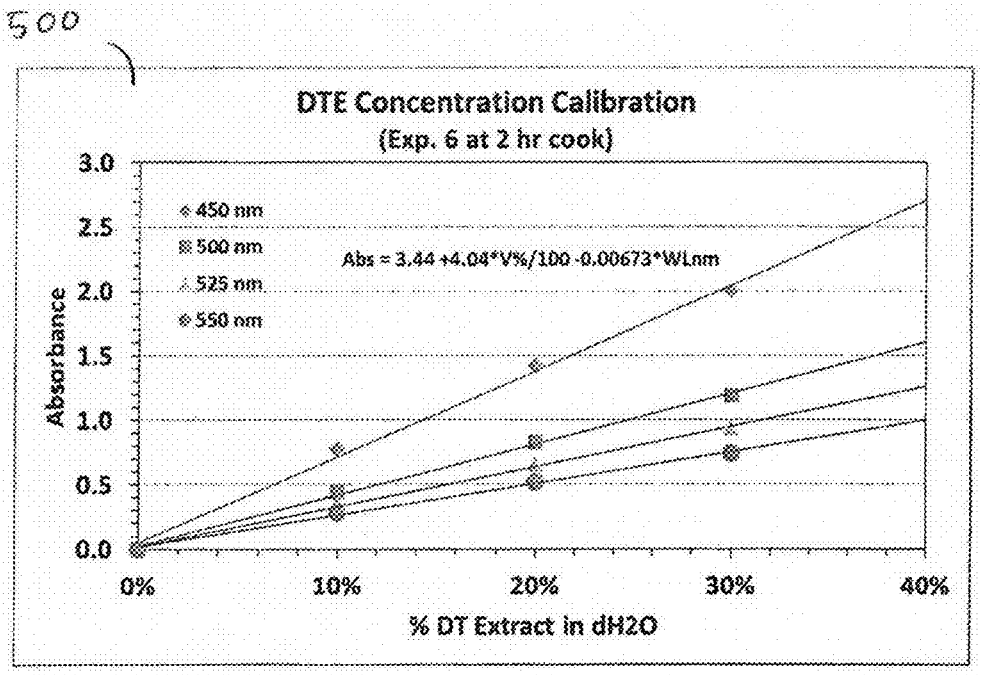
FIG. 5 shows a chart of the spectrophotometry absorbance of various concentration dilutions of a sample of the liquid tobacco extract manufactured according to the present invention relative to wavelength.

Specifically, a sample of the extracted solution manufactured according to method 100 was diluted with distilled water to several different concentration levels. Absorbance data for each case was collected in the blue (450 nm) green (500 nm) and yellow (525-550 nm) wavelength ranges. The resulting relationship and a multiple regression analysis are shown in the Table 7, below, and chart 500 in FIG. 5.

TABLE 7

| % of extract in distilled water | 450 nm | 500 nm | 525 nm | 550 nm |
|---|---|---|---|---|
| 0% | 0.000 | 0.000 | 0.000 | 0.000 |
| 10% | 0.772 | 0.442 | 0.351 | 0.282 |
| 20% | 1.420 | 0.830 | 0.656 | 0.520 |

TABLE 7-continued

| % of extract in distilled water | 450 nm | 500 nm | 525 nm | 550 nm |
|---|---|---|---|---|
| 30% | 2.000 | 1.190 | 0.935 | 0.740 |

Although the extract has some very fine particulate matter (smaller than the 100 mesh filter used), this is not sufficient to present any problem in absorbance measurement. As seen in Table 7 and chart 500, absorbance is proportional to extract concentration across a range of wavelengths, namely 450 to 550 nm. That is to say, light absorbance is a well behaved linear function of the two control variables of extract concentration and wavelength. Accordingly, by way of measuring absorbance at a determined wavelength, it is possible to monitor the strength (i.e., concentration or quality) of the extract solution manufactured according to method 100. Resultantly, spectrophotometry may be used as an objective measure for quality control of method 100.

Figure 6:
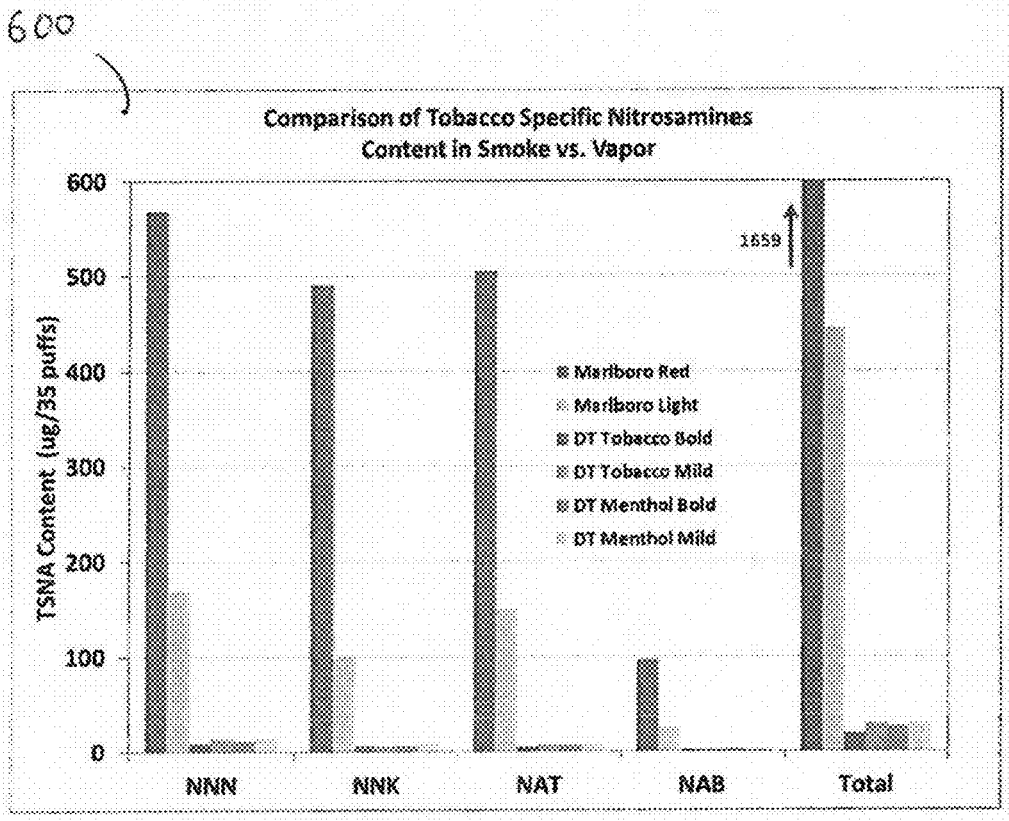
FIG. 6 shows a chart comparing the relative amounts of various tobacco specific nitrosamines in various liquid tobacco extracts manufactured according to the present invention as compared to a regular and light traditional cigarette.

In still another aspect of the present invention, method 100 may produce a tobacco extract solution that is both similar the flavor profile of a traditional tobacco cigarette, while also containing substantially fewer TSNAs (tobacco specific nitrosamines), VOC (volatile organic compounds), etc. as was mentioned above. As shown below in Table 8 and chart 600 of FIG. 6, four versions of a tobacco extract solution manufactured according to method 100 and two traditional tobacco cigarettes were tested for the presence of tobacco-specific nitrosamines. The four versions of the tobacco extract solution manufactured according to method 100 included a bold and a mild tobacco flavor solution, and a bold and mild menthol flavor solution in which a menthol flavor additive had been introduced into the tobacco extract solution. The two traditional tobacco cigarettes tested include a Marlboro® Red and a Marlboro Light® cigarette. Data for all samples are reported in nanograms per cigarette, and the comparative date for the Marlboro® Red and a Marlboro Light® cigarettes were obtained from Marlboro® KSF Filter Hard pack Light Ger UK EU Health Canada conditions and Marlboro® KSF Soft pack USA; 35 mL puff of 2 seconds duration every 60 seconds, no vents blocked, 7.6 puffs per cigarette. Counts M E, Morton M J, Laffoon S W, el al. Smoke composition and predicting relationships for international commercial cigarettes smoked with three machine smoking test mode. Regulatory Toxicology and Pharmacology. 2005; 41:185-227, incorporated herein by reference. The four individual tobacco-specific nitrosamines tested in the six samples, include N'-Nitorsonornicotine (NNN), Nitrosomine Ketone (NNK), N'-Nitoroanatabine (NAT), and N'-Nitrosoanabasine (NAB).

TABLE 8

| Tobacco-specific nitrosamines | Marlboro Red | Marlboro light | Tobacco Bold | Tobacco Mild | Menthol Bold | Menthol Mild |
|---|---|---|---|---|---|---|
| N'-Nitorsonornicotine (NNN) | 567.9 | 169.2 | 9.31 | 14.1 | 11.8 | 14.2 |
| Nitrosomine Ketone (NNK) | 489.9 | 101.5 | 5.56 | 6.14 | 5.97 | 7.86 |
| N'-Nitoroanatabine (NAT) | 504.9 | 150 | 4.11 | 7.72 | 7.37 | 6.27 |
| N'-Nitrosoanabasine (NAB) | 96.21 | 24.82 | 1.22 | 1.55 | 1.58 | 1.44 |
| Total Tobacco-specific nitrosamines | 1658.91 | 445.52 | 20.2 | 29.51 | 26.72 | 29.77 |

As seen in Table 8 and chart 600, the "Tobacco Bold" and "Menthol Bold" solutions manufactured according method 100 exhibited approximately 62 times less total Tobacco-specific nitrosamines than the counterpart Marlboro® Red cigarette. Similarly, the "Tobacco Mild" and "Menthol Mild" solutions manufactured according method 100 exhibited approximately 14 times less total Tobacco-specific nitrosamines than the counterpart Marlboro® Light cigarette.

In accordance with yet another embodiment of the present invention, the tobacco extract solution manufactured according to method 100 provides for a substantially more efficient consumption of tobacco as compared to the traditional burning and inhalation of tobacco. As shown below in Table 9, a traditional cigarette transfers approximately 0.080 grams of tobacco per puff (or inhalation) to a consumer. In contrast, vaporization of the tobacco extract solution manufactured according to method 100 transfers approximately 0.00025 grams of tobacco per puff (or inhalation) to a consumer without a significant decrease in flavor profile. Resultantly, the tobacco extract solution manufactured according to method 100 of the present invention uses approximately 0.3067% of the total tobacco that is used in a traditional cigarette, to provide a comparable smoke experience to a consumer. That is to say that a traditional cigarette uses approximately 32604% more tobacco to transfer the same amount of tobacco flavorants to the consumer, as compared to vaporization of the tobacco extract solution of the present invention

TABLE 9

Tobacco Extract Efficiency over Tobacco

| TOBACCO | |
|---|---|
| 20 | cigarettes/pack |
| 0.8 | g tobacco/cig |
| 10 | puffs/cig |
| 200 | Puffs/pack cigs |
| 0.08000 | g tobacco/puff |

TABLE 9-continued

| Tobacco Extract Efficiency over Tobacco | |
|---|---|
| TOBACCO EXTRACT | |
| 265 | g tobacco/batch |
| 3600 | mL Tobacco Extract/batch |
| 0.0736 | g tobacco/mL Extract |
| 300 | puffs/mL |
| 0.00025 | g tobacco/puff |
| 32604% | % Tobacco used in Cigarettes vs. Extract for same number of puffs |
| 0.3067% | % of Tobacco used in Extract vs. equivalent puffs on a cigarette |

Figure 7:
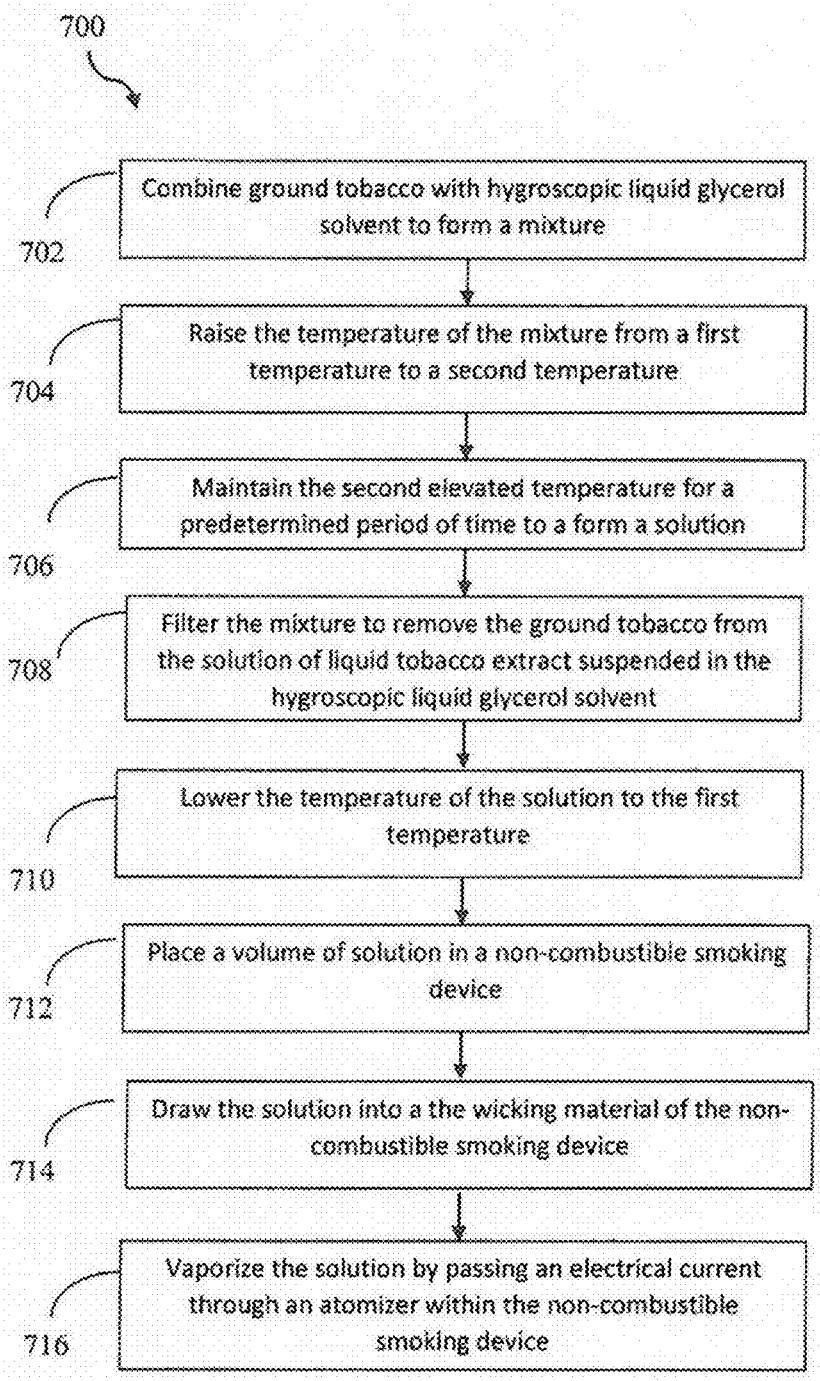
FIG. 7 illustrates a flow chart of a method of vaporizing a liquid tobacco extract according to the present invention; and In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

Referring now to FIG. 7, the method 700 of vaporizing a liquid tobacco extract is shown, in substantial similarity to the method 100 described above. That is to say that, initially a predetermined mass of ground tobacco is combined with a predetermined mass of a hygroscopic liquid glycerol solvent to form a mixture, at block 702. The temperature of the ground tobacco and hygroscopic liquid glycerol mixture is raised from a first temperature that is approximately room temperature to an elevated second temperature, at block 704. At the following block 706, the second elevated temperature of the mixture was maintained for a predetermined period of time to a form a solution having a volume of a liquid tobacco extract suspended in the liquid glycerol solvent. The mixture is then filtered to remove the ground tobacco from the solution of liquid tobacco extract suspended in the solvent, at block 708; and, the temperature of the solution is then lowered from the second temperature to the first temperature at block 710.

After the temperature of the solution has been lowered, a volume of solution is then placed in a non-combustible smoking device at block 712. In one embodiment this may include placing a volume of the solution into a cartridge within the electronic cigarette, adjacent a wicking material. At subsequent block 714, the solution is drawing into the wicking material, which is in fluid communication with the cartridge or reservoir of solution in the non-combustible smoking device. Then an electrical current is passed through an atomizer within the non-combustible smoking device, which results in the vaporization of the solution at block 716. The atomizer may include a wire that is either in contact with or adjacent to the wicking material, and that has an electrical resistance that when passing an electrical current through the wire causes the temperature of the solution in the wicking material to rise to a third temperature that is at least equal to a vaporization temperature of the solution.

Moreover, the individual components need not be formed in the disclosed shapes, or assembled in the disclosed configuration, but could be provided in virtually any shape, and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

What is claimed is:

1. A method for manufacturing a liquid tobacco extract configured for vaporization in a non-combustible smoking device, the method comprising the steps of:

combining a predetermined mass of ground tobacco in a predetermined mass of a hygroscopic liquid glycerol solvent to form a mixture;

increasing the temperature of the mixture from a first temperature to an elevated second temperature, the second temperature being approximately 250 degrees Fahrenheit;

maintaining the mixture at the elevated second temperature for a predetermined period of time of between 100 and 150 minutes to a form a solution having a volume of a liquid tobacco extract suspended in the liquid glycerol solvent;

filtering the mixture to remove the ground tobacco from the solution of the liquid tobacco extract suspended in the solvent having a percentage nicotine of approximately 0.05, a pH of approximately 5.5, and a volume of tobacco specific a nitrosamines of less than 100 nanograms per 35 puffs; and lowering the temperature of the solution from the second temperature to the first temperature.

2. The method of claim 1, further comprising the step of pressing the ground tobacco after filtered to remove additional solution therefrom.

3. The method of claim 1, wherein the predetermined period of time is approximately 120 minutes.

4. The method of claim 1, wherein a ratio of the hygroscopic liquid glycerol solvent to ground tobacco is approximately 20:1.

5. The method of claim 1, wherein the predetermined mass of hygroscopic liquid glycerol solvent is approximately 20 times greater than the predetermined mass of ground tobacco.

6. The method of claim 1, wherein the hygroscopic liquid glycerol solvent is approximately a vegetable glycerol.

7. The method of claim 1, further comprising the step of adding a predetermined mass of a solvent to the solution to form a liquid tobacco extract having a final percentage nicotine of approximately 0.05%.

8. The method of claim 1, further comprising the step of adding a predetermined mass of a nicotine extract to the solution to form a liquid tobacco extract having a final percentage nicotine of approximately between 1% and 3%.

9. The method of claim 1, further comprising the step of adding a predetermined mass of a non-tobacco flavor additive to the solution.

10. The method of claim 1, wherein the solution is substantially free of water.

11. The method of claim 1, wherein the first mixture is filtered at a pressure of greater than 1,500 KPa.

12. The method of claim 1, wherein the solution is substantially free of solid particulates.

13. The method of claim 1, wherein the solution has an absorbance of between 0.4 AU and 0.6 AU when exposed to a 500 nm wavelength light.

14. A method for vaporizing a liquid tobacco extract configured in a non-combustible smoking device, the method comprising the steps of:

combining a predetermined mass of ground tobacco in a predetermined mass of a hygroscopic liquid glycerol solvent to form a mixture;

increasing the temperature of the mixture from a first temperature to an elevated second temperature, the second temperature being approximately 250 degrees Fahrenheit;

maintaining the mixture at the elevated second temperature for a predetermined period of time of between 100 and 150 minutes to a form a solution having a volume of a liquid tobacco extract suspended in the liquid glycerol solvent;

filtering the mixture to remove the ground tobacco from the solution of the liquid tobacco extract suspended in the solvent having a percentage nicotine of approximately 0.05%, a pH of approximately 5.5, and a volume of tobacco specific a nitrosaimines of less than 100 nanograms per 35 puffs;

lowering the temperature of the solution from the second temperature to the first temperature;

placing a volume of the solution into a cartridge within the non-combustible smoking device adjacent a wicking material;

drawing the solution into the wicking material; and vaporizing the solution in the wicking material by passing an electrical current through an atomizer.

15. The method of claim 14, wherein the atomizer is a wire located around at least a portion of the wicking material.

16. The method of claim 15, wherein the wire has an electrical resistance that causes the temperature of the solution in the wicking material to rise to a third temperature that is at least equal to a vaporization temperature of the solution.

17. The method of claim 14, further comprising the step of adding a predetermined mass of a nicotine extract to the solution to form a liquid tobacco extract having a final percentage nicotine of approximately between 1% and 3% prior to placing the volume of the solution into a cartridge within the electronic cigarette adjacent the wicking material.

18. The method of claim 14, further comprising the step of adding a predetermined mass of a non-tobacco flavor additive to the solution prior to placing the volume of the solution into a cartridge within the electronic cigarette adjacent the wicking material.

19. The method of claim 14, wherein the solution has an absorbance of between 0.4 AU and 0.6 AU when exposed to a 500 nm wavelength light.

* * * * *